US006634171B1

(12) United States Patent
Banks, III

(10) Patent No.: US 6,634,171 B1
(45) Date of Patent: Oct. 21, 2003

(54) EXHAUST SCAVENGING SYSTEM

(76) Inventor: Gale C. Banks, III, 157 Sawpit La., Bradbury, CA (US) 91010

( * ) Notice: Subject to any disclaimer, the term of this patent is extended or adjusted under 35 U.S.C. 154(b) by 138 days.

(21) Appl. No.: 09/428,594

(22) Filed: Oct. 27, 1999

(51) Int. Cl.[7] ..... F01B 27/02
(52) U.S. Cl. ..... 60/313; 60/323
(58) Field of Search ..... 60/313, 312, 323

(56) References Cited

U.S. PATENT DOCUMENTS

| | | | | | |
|---|---|---|---|---|---|
| 3,491,534 | A | * | 1/1970 | Garner | 60/313 |
| 3,507,301 | A | * | 4/1970 | Larson | 60/313 |
| 4,796,426 | A | * | 1/1989 | Feuling | 60/313 |
| 5,216,883 | A | | 6/1993 | Flugger | |
| 5,299,419 | A | * | 4/1994 | Bittle et al. | 60/313 |
| 5,678,404 | A | * | 10/1997 | McManus | 60/313 |
| 5,765,373 | A | | 6/1998 | Bittle et al. | |

FOREIGN PATENT DOCUMENTS

| | | | |
|---|---|---|---|
| EP | 0284466 A1 | * | 9/1988 |
| JP | 60-88816 | * | 5/1985 |

* cited by examiner

*Primary Examiner*—Thomas Denion
*Assistant Examiner*—Tu M. Nguyen
(74) *Attorney, Agent, or Firm*—Fulbright & Jaworski L.L.P.

(57) ABSTRACT

An exhaust scavenging system for an internal combustion engine including exhaust passages extending from the engine and an exhaust outlet system. A collector extends from the bundled ends of the exhaust passages to the exhaust outlet system. A flow enhancement element extends into the collector from a central position among the bundled exhaust passage outlets. The flow enhancement element may be fixed, adjustable axially or modulated axially. When modulated, a controller controls the actuator based on engine parameters with a feedback loop either directly from the actuator or through further measurement of engine conditions. When adjustable, the flow enhancement element can range in position from a retracted position to an extended position. The transverse cross-sectional area of the flow enhancement element through at least half of the transition collector portion from the outlet plane is not substantially less than the transverse cross-sectional area of the flow enhancement element at the outlet plane in the extended position and does decrease continuously through the transition collector portion from the outlet plane in the retracted position.

13 Claims, 4 Drawing Sheets

EXHAUST SCAVENGING SYSTEM

BACKGROUND OF THE INVENTION

The field of the present invention is exhaust systems for variable volume internal combustion engines.

Variable volume internal combustion engines are most commonly Otto cycle or diesel cycle engines. Each typically employs an exhaust scavenging system for directing the exhaust from these engines away from the engine and to a common exhaust outlet system. Scavenging systems include individual exhaust passages extending from a bank of cylinders and converging to a bundle at the outlets from the exhaust passages. Exhaust outlet systems typically include a singular tube to receive flow from the bundle of exhaust passages. Collectors transition between the exhaust scavenging systems and the exhaust outlet systems.

In directing the exhaust away from the engine, such scavenging systems have long been designed to reduce restrictions which compromise airflow through the engine. Resistance to airflow raises exhaust port pressures and reduces engine efficiency. Designs also attempt to enhance performance through tuning of the lengths of the exhaust passages. Tuning is possible because the exhaust exits the engine in the form of pulses from each cylinder. The pressure waves associated with this pulsing can be utilized to aid in the timed reduction of pressure. Such systems take advantage of a rarefaction wave that follows the pressure wave to sequentially reduce the exhaust port pressure for the next exhausting cylinder.

A collector is used to transition the flow from the separately tuned exhaust passages to a common exhaust outlet system. Collectors typically have one end extending about the collected exhaust passages. As the exhaust passages are typically cylindrical pipe, they are brought together in a circular pattern with each exhaust passage touching two adjacent exhaust passages. The end of the collector is, therefore, scalloped to accommodate each of the pipes in order to form the seal. The ridges and valleys of the collector at this scalloped end extend toward the other end of the collector but transition slowly to a circular configuration for interfacing with the singular tube of the exhaust outlet system.

Traditionally, a plate to block off the center space defined by the circularly arranged tubes is welded in place. This arrangement creates an obvious discontinuity in the flow path at the exhaust passage exit. Efforts have been made to provide a smooth transition from the exhaust passages into the collector by using an aerodynamic trailing surface such as a pyramidal structure with the base covering the center space and the apex extending some distance axially into the collector. Two such devices are illustrated in U.S. Pat. No. 3,507,301 and U.S. Pat. No. 5,765,373.

The exhaust outlet system to which the collector interfaces typically includes a single tube extending to a remote release such as the exhaust pipe of a vehicle. Devices are typically included with such exhaust outlet systems such as sound attenuating devices, pollutant converting devices and even turbochargers. On specialty uses, a simple short tube may define the exhaust outlet system. When an engine has more than one bank of cylinders, each bank includes exhaust passages extending to a collector for each bank. The exhaust tubes from the collectors often merge well downstream of the collectors to share the exhaust devices.

In operation, when an exhaust valve of a multi-valve engine opens to relieve the gases of combustion, the associated piston of that engine moves upwardly to fully exhaust the cylinder. This exhaust pulse then moves through the system to atmosphere. The exhaust valve is usually timed to open somewhat before the piston reaches the bottom of its power stroke and before the actual exhaust stroke. The combustion within the cylinder is nearing completion at this time but is still expanding. Upon the opening of the exhaust valve, the hot expanding gases rush into the exhaust port and continue to flow out of the cylinder. Pressure is reduced within the cylinder and the piston rises up to push the remaining combusted gas out until the exhaust valve closes. Depending on the settings of the engine, this valve closure will occur slightly before to slightly after the piston reaches the top of its stroke.

If the exhaust from the open exhaust valve enters a length of exhaust passage, it will travel down the passage as a high-pressure pulse, sometimes referred to as an energy slug, to exit at atmospheric pressure. When the exhaust valve closes, the flow from the cylinder stops but inertia continues the flow of the exhaust pulse toward the outlet. As the exhaust pulse moves down the passage away from the closed exhaust valve, pressure is reduced in the area behind the moving pulse to a level below atmospheric pressure.

If the aforementioned exhaust passage exits into a collection chamber that is larger, the tail end of the high pressure exhaust pulse will expand and slow down as it enters this chamber. As the exhaust pulse passes through the outlet of the collection chamber into the secondary piping, another sub-atmospheric pressure pulse is created in the collection chamber behind the exiting high-pressure exhaust pulse.

If primary exhaust passages from other cylinders of a multi-cylinder engine enter the collection chamber, the sub-atmospheric pulse from one primary passage exiting the chamber will cause a reverse direction pulse in any other primary passages entering the collection chamber. By sizing the length and diameter of the manifold passages in relation to a given engine speed range, the arrival of this low-pressure pulse can be timed so that it arrives as the exhaust valve of another cylinder opens. The presence of this low-pressure area generated by the prior valve closure and ahead of the high-pressure pulse to be leaving the opening of the next exhaust valve will aid in the flow, or scavenging, of the high-pressure pulse from the cylinder. If the low-pressure pulse is present during the overlap period when both exhaust and intake valves are partially open, the pulse will assist in drawing intake air across and through the combustion chamber. The column inertia of this flow will further increase the volumetric efficiency of the cylinder.

The shape and the volume of the collection chamber, or collector, plays an important role in the effect of the low-pressure pulse on the primary passages from other cylinders. As the volume of the collector is reduced, the low-pressure pulse leaving one of the primary passages will have a greater influence in lowering the pressure in the other primary passages entering the collector. For tuning to lower engine speeds, other conditions remaining the same, the collector volume is smaller to maintain the exhaust gas velocity needed to produce a strong influence of the low-pressure pulse on the other exhaust passages entering the collector.

Because the high and low-pressure pulses must travel over a distance through the passages and occur at varying frequencies as the engine speed is changed, the most noticeable scavenging effect will occur within a specific speed range of the engine for a given exhaust manifold configuration. The lengths of the primary passages are normally made equal, and established to maximize the scavenging effect within a desired engine speed range. Engines intended for high performance, the extreme being for racing, have exhaust manifolds tuned to scavenge at high engine speeds, those used for towing heavy payloads or in heavily laden vehicles such as motor home coaches are designed to scavenge best at lower engine speeds with an emphasis on increasing engine torque output.

With a greater number of passages entering the collector as in larger engines with more cylinders, the area of the inlet face of the collector will increase. The center space, or void, Within the circle of primary passages also becomes greater. The passages are further displaced from a common center line and, if other dimensions remain equal, the collector volume increases. It becomes increasing difficult to manufacture a low volume collector for an 8, 10 or 12 cylinder engine to be used at lower operating speeds for towing or in heavy recreational vehicles. These engines are usually configured with two banks of cylinders forming a "V". Each bank of cylinders is served by manifold having a primary passage for each cylinder exiting into a common collector that feeds into an exhaust outlet system. Thus a V-10 engine would have two collectors, each connected to five primary pipes. Traditionally, efforts have been focused on exhaust passage length and diameter to promote exhaust scavenging. These two parameters will influence the engine speed range at which the scavenging efforts are most pronounced. Tuning the primary passage lengths and diameters for a specific engine speed range is common practice in the industry producing tubular exhaust manifolds, also known as headers.

The design of collectors has also been employed to enhance scavenging. By reducing the length of the collector, volume is reduced and the flow pressure pulses will have a stronger influence on other primary exhaust passages. This can only be carried on to a point, beyond which the collector sides create such a sharp angle that the collector begins to become a resistance to flow. As mentioned above, the collector is typically scalloped to conform to the exhaust passages, which reduces volume within the collector. The arrangement of the outlets of the exhaust passages bundled in a circle also reduces the volume of the collector.

SUMMARY OF THE INVENTION

The invention is directed to an exhaust scavenging system for an internal combustion engine. Exhaust passages extend from the engine and include outlets bundled substantially at a outlet plane. A collector includes an inlet portion extending about the bundled exhaust passages, an outlet portion configured to interface with the singular tube of an exhaust outlet system and a transition portion therebetween defining a flow transition between the inlet and outlet portions. A flow enhancement element is centered at the bundled exhaust passage outlets and extends into the transition portion of the collector. The flow enhancement element advantageously affects exhaust flow through the system.

In a first separate aspect of the present invention, the flow enhancement element of the exhaust scavenging system includes a transverse cross-sectional area which, through at least half of the transition collector portion from the outlet plane, is not substantially less than the transverse cross-sectional area of the flow enhancement element at the outlet plane when in the extended position. This retention of size may be maintained even though the overall cross-sectional flow path within the collector may be decreasing toward an interface with the exhaust outlet system. Improved maintenance of the pulse speed is desired.

In a second separate aspect of the present invention, the flow enhancement element in the exhaust scavenging system is slidable axially within the collector. The position of the flow enhancement element may be simply adjustable for tuning to a specific set of engine conditions. Alternatively, the flow enhancement element may be modulated according to varying engine parameters such as gas flow rate and/or engine speed. When adjustable, a retracted position of the flow enhancement may further be defined as having a cross-sectional area decreasing continuously through the transition collector portion from the outlet plane while the extended position may define the flow enhancement element as in the first separate aspect.

In a third separate aspect of the present invention, the foregoing aspects and possibilities may be combined.

Accordingly, it is an object of the present invention to provide an improved exhaust scavenging system for an internal combustion engine employing a flow enhancement element in the collector. Other and further objects and advantages will appear hereinafter.

DETAILED DESCRIPTION OF THE PREFERRED EMBODIMENTS

Figure 1:
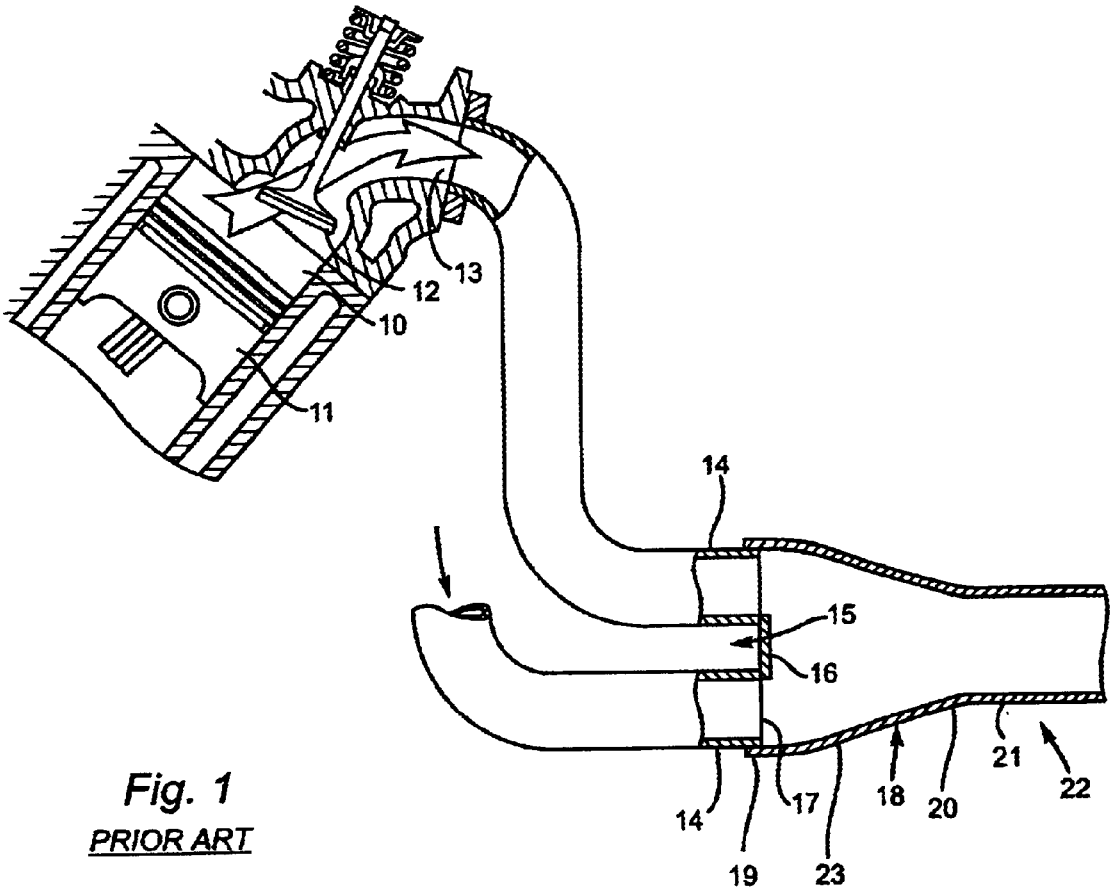
Fig. 1 PRIOR ART
FIG. 1 is a side view partially cross sectioned illustrating a prior art exhaust scavenging system.

FIG. 1 illustrates a conventional system. A cylinder 10 of a bank of cylinders includes a reciprocating piston 11, an exhaust valve 12 and the exhaust port 13. Two exhaust passages 14 are illustrated in a system which would include a bundling of three or more such passages from the cylinder bank. With the passages 14 typically bundled such that the passages are arranged in a circle and are equidistant from a common centerline, a center space 15 is defined between the passages 14. In the prior art, a plate 16 is typically welded over the center space to seal the inner periphery defined by the arranged passage bundle. The outlets 17 of the exhaust tubes 14 lie in an outlet plane effectively including the plate 16. Typically, each passage is touching two adjacent passages at this outlet plane.

The end of the exhaust passage bundle at the outlet 17 is shown to be enclosed by a collector 18. The collector 18 includes an inlet collector portion 19 extending about the exhaust passages at the outlet plane in sealed arrangement at the periphery of the bundle. The shape of the collector 18 in cross section in this inlet collector portion 19 includes lobes to fit about each of the tubes 14. The shape may otherwise be described as scalloped. An outlet collector portion 20 of the collector 18 provides an interface with the singular tube 21 of an exhaust outlet system 22. The outlet system 22 is shown in this illustrative embodiment to be integral with the collector 18. A flanged joint may be employed at any point therealong.

A transition collector portion 23 between the inlet and outlet collector portions 19 and 20 provides flow transition between the two cross-sectional shapes and sizes. The cross-section shape typically progresses from the scalloped periphery to a circular periphery. Both ends of the conduit are sealed with the associated system so as to prevent exhaust leakage. Typically the total cross-sectional passage area of the collector 18 at the tubes 14 is greater than at the interface with the exhaust outlet system 22. The flow transition through the portion 23 may be smooth or disrupted, depending on the needs of the system.

Figure 2:
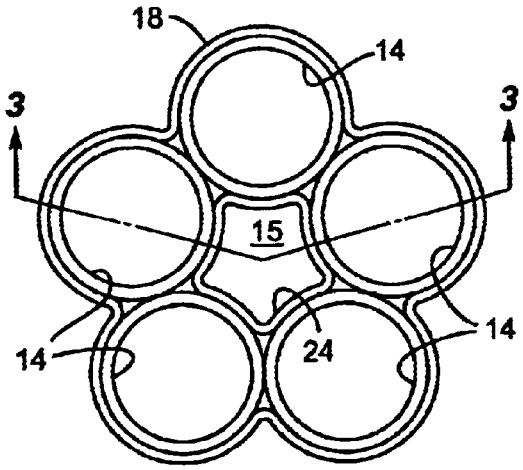
FIG. 2 is a cross-sectional view of a collector taken along line 2—2 of FIG. 3.
Figure 3:
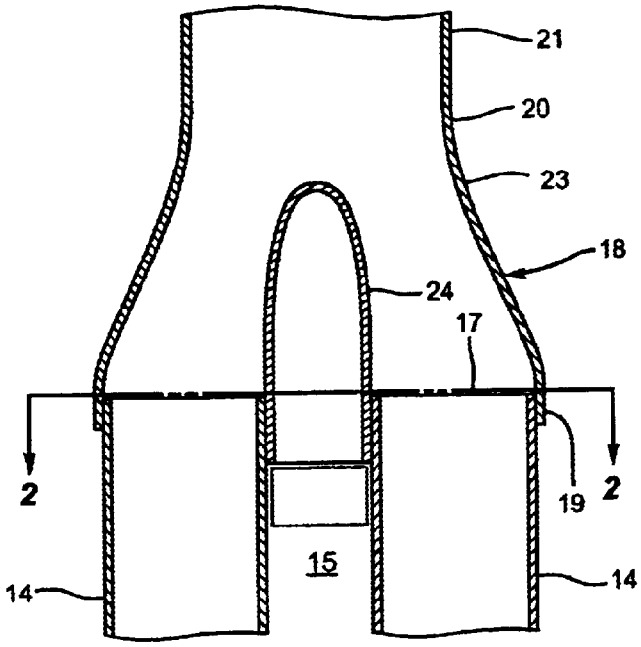
FIG. 3 is a cross-sectional view taken along line 3—3 of FIG. 2.
Figure 4:
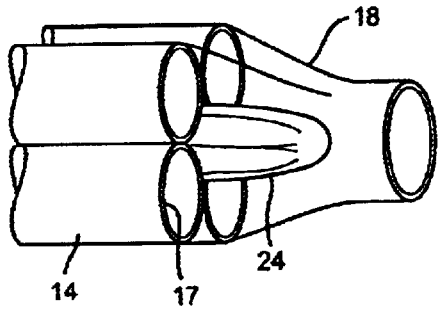
FIG. 4 is a perspective view of a first embodiment with the collector transparent for clarity.

Turning to FIGS. 3 and 4, a first preferred embodiment is illustrated. A flow enhancement element 24 is illustrated as extending into the collector 18 from the center space 15 at the end of the bundle of passages 14. The flow enhancement element 24 seals off the inner periphery of the bundle of passages 14 and has a scalloped periphery to match the tubes. This scalloped cross section extends through over 60% of the length of the flow enhancement element 24. The element 24 then transitions to a domed end which is circular in cross section. With this shape, the element 24 substantially does not decrease in cross section through at least one-half of the transition collector portion 23 with the element fully extended. An insubstantial decrease in cross sectional area is present because of a small draft which significantly eases fabrication. The flow enhancement element 24 is shown to extend substantially through the transition portion 23 along the common centerline. The embodiment of FIGS. 2 and 3 is indeterminate as to whether the flow enhancement element 24 is fixed, adjustable or modulated.

Figure 5:
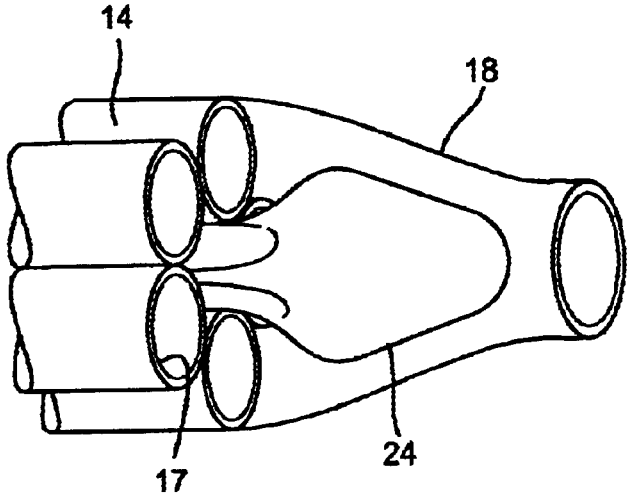
FIG. 5 is a perspective view of a second embodiment with the collector transparent for clarity.
Figure 6:
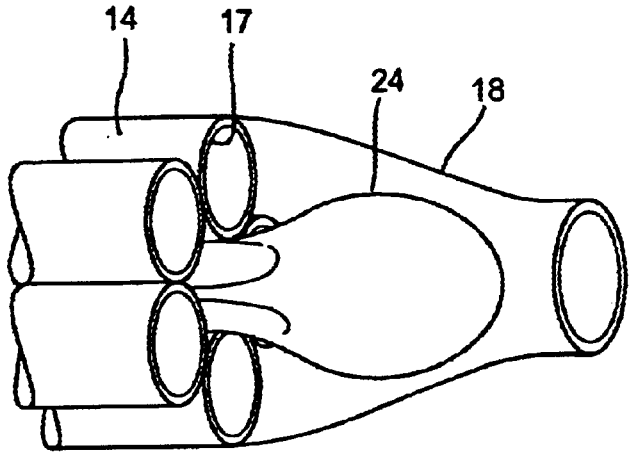
FIG. 6 is a perspective view of a third embodiment with the collector transparent for clarity.
Figure 7:
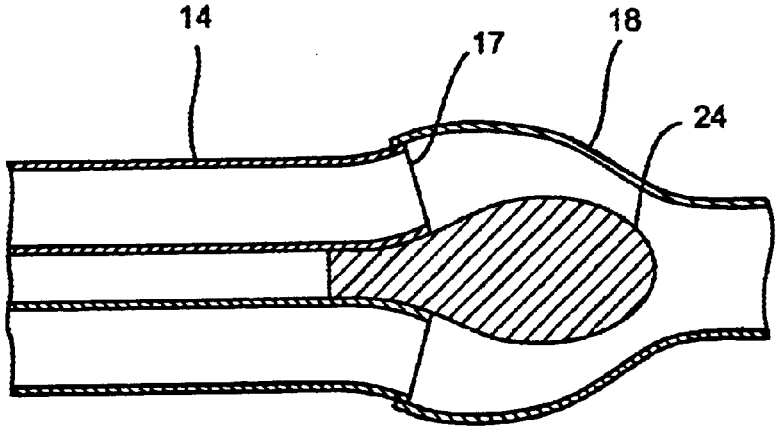
FIG. 7 is a cross-sectional view of a fourth embodiment with the collector transparent for clarity.

FIGS. 5, 6 and 7 illustrate other possible embodiments. FIG. 7 illustrates a circumstance where the tubes 14 splay outwardly at the outlet plane.

Figure 8:
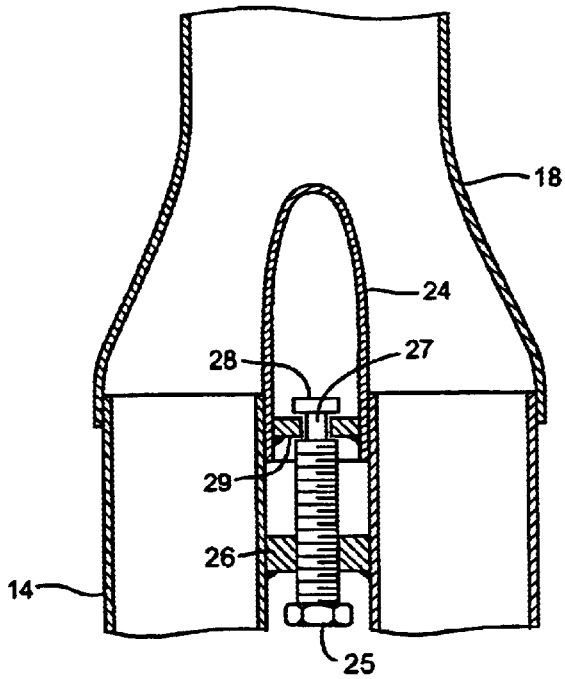
FIG. 8 is a cross-sectional view as presented in FIG. 3 with a manual adjustment for the flow enhancement element illustrated.

FIG. 8 shows an actuator for adjusting the position of the flow enhancement element 24. The actuator 25 is retained in threaded engagement with a mounting plate 26 welded to the passages 14. The actuator 25 includes a smooth shank 27 with a larger retainer 28. The retainer 28 captures an attachment plate 29 about the smooth shank 27. The attachment plate 29 is welded to the flow enhancement element 24 such that rotation of the actuator 25 will extend or retract the flow enhancement element 24 into and out of the collector 28. In this way, the actuator can assume a continuum of positions from an extended position fully deployed within the collector 18 to a retracted position such that the device simply provides a smooth transition from the transition portion 19 to the transition portion 23 of the collector 18 without affecting gas flow velocity. In this position, the discontinuity at the outlet 17 of the tubes 14 is substantially reduced. The slidable association of the flow enhancement element 24 with the tubes 14 enables the tuning of the exhaust scavenging system to specific engine conditions. With large engines for truck, motor home and trailer pulling employment, the flow enhancement element 24 is typically extended to the extended position to enhance low speed torque.

Figure 9:
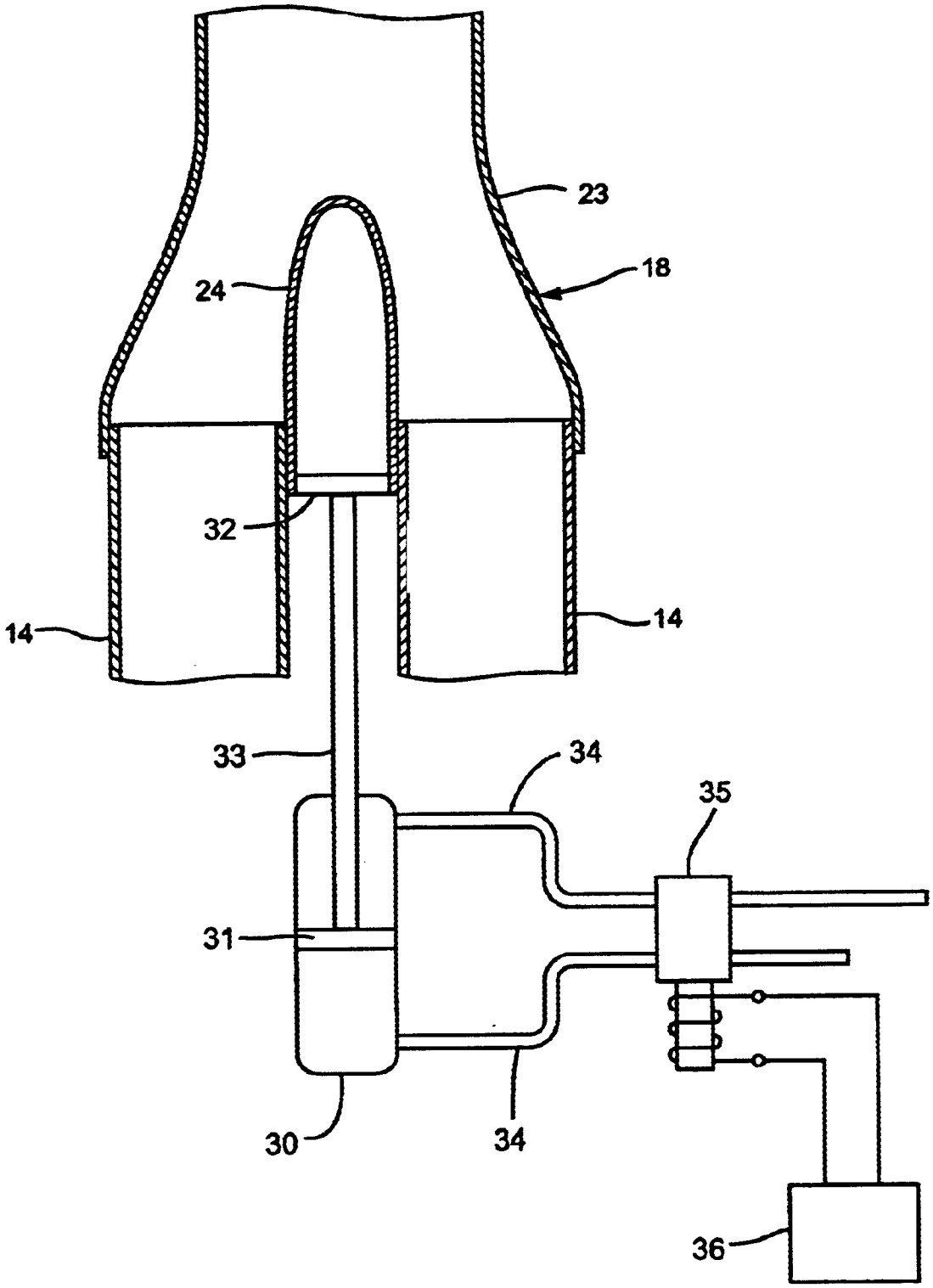
FIG. 9 is a cross-sectional view as presented in FIG. 3 with an adjustment for the flow enhancement element with a modulated adjustment illustrated.

FIG. 9 illustrates a modulated adjustment system for the flow enhancement element 24. A hydraulic or pneumatic actuator 30 having a piston or diaphragm 31 is coupled with a back plate 32 of the flow enhancement element 24 by an actuator rod 33. Oil pressure or pneumatic vacuum is supplied through lines 34 to the actuator. A directional control valve 35 controls flow through the lines 34 to position the actuator rod and in turn the flow enhancement element 24. A controller 36 controls the valve 35. Input is received by the controller from engine parameters. Further, input is received as part of a feedback loop. The engine parameters might include exhaust flow or pressure, engine speed throttle or fuel valve opening or the like. Feedback may be provided by a position sensor associated with the actuator rod 33, a pressure or pressure differential sensor, a flow rate sensor or the like. In the latter possibilities, the operation of the engine itself is included in the feedback loop.

Thus, an improved exhaust scavenging system has been disclosed. While embodiments and applications of this invention have been shown and described, it would be apparent to those skilled in the art that many more modifications are possible without departing from the inventive concepts herein. The invention, therefore is not to be restricted except in the spirit of the appended claims.

What is claimed is:

1. An exhaust scavenging system for an internal combustion engine, comprising at least three exhaust passages extending from the engine, each including an outlet, the outlets being equidistant from a common center line and terminating substantially in an outlet plane, the exhaust passage outlets defining a center space thereamong;

an exhaust outlet system including a singular tube;

a collector having an inlet collector portion configured to interface with and extend about the exhaust passages at the outlet plane in sealed arrangement, an outlet collector portion configured to interface with the singular tube of the exhaust outlet system and a transition collector portion between and providing flow transition between the inlet and outlet collector portions; and a flow enhancement element in sealed arrangement with the exhaust passages at the outlet plane to close the center space and extending in an extended position along the common center line into the transition collector portion, the transverse cross-sectional area of the flow enhancement element through at least half of the transition collector portion from the outlet plane not being substantially less than the transverse cross-sectional area of the flow enhancement element at the outlet plane.

2. The exhaust scavenging system for an internal combustion engine of claim 1, each of the exhaust passages touching two adjacent exhaust passages at the outlets.

3. The exhaust scavenging system for an internal combustion engine of claim 1, the transition collector portion defining a smooth flow transition between the first and second collector portions.

4. The exhaust scavenging system for an internal combustion engine of claim 1, the flow enhancement element and the transition collector portion thereabout defining a cross-sectional flow area continuously decreasing substantially from the inlet collector portion to the outlet collector portion.

5. The exhaust scavenging system for an internal combustion engine of claim 1, wherein high pressure exhaust pulses emerging at the outlet plane from each of the exhaust passages communicate with adjacent ones of the exhaust passages at the outlet plane.

6. The exhaust scavenging system for an internal combustion engine of claim 1, the flow enhancement element being slidable relative to the outlet plane from the extended position to a retracted position, the transverse cross-sectional area of the flow enhancement element decreasing continuously through the transition collector portion from the outlet plane in the retracted position.

7. The exhaust scavenging system for an internal combustion engine of claim 6 further comprising an actuator coupled with the flow enhancement element and responsive to at least one engine parameter to move the flow enhancement element toward the extended and retracted positions based on a function of the at least one engine parameter.

8. The exhaust scavenging system for an internal combustion engine of claim 7, the actuator retracting the flow enhancement element with increasing engine speed.

9. An exhaust scavenging system for an internal combustion engine, comprising at least three exhaust passages extending from the engine, each including an outlet, the outlets being equidistant from a common center line and terminating substantially in an outlet plane, the exhaust passage outlets defining a center space thereamong;

an exhaust outlet system including a singular tube;

a collector having an inlet collector portion configured to interface with and extend about the exhaust passages at the outlet plane in sealed arrangement, an outlet collector portion configured to interface with the singular tube of the exhaust outlet system and a transition collector portion between and providing flow transition between the inlet and outlet collector portions;

a flow enhancement element in sealed arrangement with the exhaust passages at the outlet plane to close the center space and extending solely from the center space into the transition collector portion, the flow enhancement element being slidable relative to the outlet plane between an extended position and a retracted position; and an actuator coupled with the flow enhancement element and responsive to at least one engine parameter to move the flow enhancement element toward the extended and retracted positions based on a function of the at least one engine parameter.

10. An exhaust scavenging system for an internal combustion engine, comprising at least three exhaust passages extending from the engine, each including an outlet, the outlets being equidistant from a common center line and terminating substantially in an outlet plane, the exhaust passage outlets defining a center space thereamong;

an exhaust outlet system including a singular tube;

a collector having an inlet collector portion configured to interface with and extend about the exhaust passages at the outlet plane in sealed arrangement, an outlet collector portion configured to interface with the singular tube of the exhaust outlet system and a transition collector portion between and providing flow transition between the inlet and outlet collector portions;

a flow enhancement element in sealed arrangement with the exhaust passages at the outlet plane to close the center space and extending along the common center line into the transition collector portion, the flow enhancement element being slidable relative to the outlet plane between an extended position and a retracted position, the transverse cross-sectional area of the flow enhancement element through at least half of the transition collector portion from the outlet plane not being substantially less than the transverse cross-sectional area of the flow enhancement element at the outlet plane in the extended position and decreasing continuously through the transition collector portion from the outlet plane in the retracted position; and an actuator coupled with the flow enhancement element and responsive to at least one engine parameter to move the flow enhancement element toward the extended and retracted positions based on a function of the at least one engine parameter.

11. The exhaust scavenging system for an internal combustion engine of claim 10, the actuator retracting the flow enhancement element with increasing engine speed.

12. The exhaust scavenging system for an internal combustion engine of claim 10, wherein high pressure exhaust pulses emerging at the outlet plane from each of the exhaust passages communicate with adjacent ones of the exhaust passages at the outlet plane.

13. An exhaust scavenging system for an internal combustion engine, comprising at least three exhaust passages extending from the engine, each including an outlet, the outlets being equidistant from a common center line and terminating substantially in an outlet plane, the exhaust passage outlets defining a center space thereamong;

an exhaust outlet system including a singular tube;

a collector having an inlet collector portion configured to interface with and extend about the exhaust passages at the outlet plane in sealed arrangement, an outlet collector portion configured to interface with the singular tube of the exhaust outlet system and a transition collector portion between and providing flow transition between the inlet and outlet collector portions;

a flow enhancement element in sealed arrangement with the exhaust passages at the outlet plane to close the center space and extending solely from the center space into the transition collector portion with lateral flow communication between adjacent ones of the exhaust passages at the outlet plane, the flow enhancement element being slidable relative to the outlet plane between an extended position and a retracted position; and an actuator coupled with the flow enhancement element and responsive to at least one engine parameter to move the flow enhancement element toward the extended and retracted positions based on a function of the at least one engine parameter.

* * * * *